United States Patent [19]

Habedank et al.

[11] 4,211,906

[45] Jul. 8, 1980

[54] ROTARY ACTUATING DEVICE FOR LOW-VOLTAGE CIRCUIT BREAKERS WITH TOGGLE LEVER

[75] Inventors: Klaus-Dieter Habedank; Werner Troebel, both of Berlin, Fed. Rep. of Germany

[73] Assignee: Siemens Aktiengesellschaft, Berlin and Munich, Fed. Rep. of Germany

[21] Appl. No.: 27,159

[22] Filed: Apr. 4, 1979

[30] Foreign Application Priority Data

Apr. 5, 1978 [DE] Fed. Rep. of Germany ..... 2815129

[51] Int. Cl.[2] ..... H01H 3/20; H01H 3/00

[52] U.S. Cl. ..... 200/330; 200/153 G

[58] Field of Search ..... 200/330, 339, 153 G, 200/153 T

[56] References Cited

U.S. PATENT DOCUMENTS

| | | | |
|---|---|---|---|
| 2,213,657 | 9/1940 | Rowe | 200/330 |
| 2,830,154 | 4/1958 | Herrmann et al. | 200/153 G |
| 2,849,581 | 8/1958 | Bingenheimer | 200/153 G |
| 2,961,501 | 11/1960 | Piteo, Jr. | 200/330 X |
| 2,989,612 | 6/1961 | Brown | 200/153 G X |
| 3,134,877 | 5/1964 | Ericson | 200/153 G |
| 3,752,947 | 8/1973 | Strobel | 200/330 |

*Primary Examiner*—Steven M. Pollard
*Attorney, Agent, or Firm*—Kenyon & Kenyon

[57] ABSTRACT

An actuating device for attachment to a toggle actuated low-voltage circuit breaker having an insulating housing has a housing and a guide mechanism supported therein including a fork-shaped lever which can be turned and which transforms the rotary motion into the rectilinear motion needed to actuating the toggle lever. A slider, movably guided radial to the axis of rotation by the fork arms of the lever, has a circular cylindrical opening which receives a substantially spherical head piece. The head piece contains an opening for receiving the end of the toggle lever. The housing of the actuating device contains a slideway which serves as a guide surface for the head piece. An operating handle can be placed on a shaft end of the fork-shaped lever.

5 Claims, 5 Drawing Figures

ROTARY ACTUATING DEVICE FOR LOW-VOLTAGE CIRCUIT BREAKERS WITH TOGGLE LEVER

BACKGROUND OF THE INVENTION

1. Field of the Invention

This invention relates to an actuating device useful as an attachment to a low-voltage circuit breaker having an insulating housing and a protruding toggle lever. The actuator has a housing and a fork-shaped guide mechanism including a lever which can be actuated by a pivoted operating handle, for transforming a rotary motion executed by the operating handle into a rectilinear movement of the toggle lever.

2. Discussion of the Prior Art

An actuating device of this type is described in U.S. Pat. No. 3,752,947. There, a fork-shaped lever cooperates with the free end of another, pivoted lever which extends, with an opening, over the end of the toggle lever, being connected to it via rollers. A roller is also attached to the end of the toggle lever. Use of this actuating device therefore requires a toggle lever having such a roller, a deviation from the usual shape of toggle levers. It is an object of the present invention to eliminate the need for a specially designed toggle lever, while retaining the advantage of low-friction operation resulting from use of the actuating device and, thereby to make retrofit of unmodified breakers possible.

SUMMARY OF THE INVENTION

According to the present invention, the above problem is solved by providing the fork-shaped lever with a slider which is guided radially relative to the fulcrum of the lever and which a head piece having an opening for accepting the end of the toggle lever and a spherical surface for cooperating with the slider. Tests have shown that this arrangement presents relatively low friction resistance and therefore enables development of the necessary actuating forces with a relatively short operating handle. Apart from the small number of moving parts, an actuating device fabricated in accordance with the invention has the further advantage that only a head piece needs to be slipped on when the actuating device is to be used in connection with a low-voltage circuit breaker.

In one embodiment, the fork tines of the lever may have slots for radial guidance of the slider. The slider has approximately the shape of a rectangular plate.

The head piece is in the form of a sphere having a flat. The receiving opening for the end of the toggle lever starts at the flat. Such a head piece can be made by a pressing or injection molding process of a suitable plastic in one piece.

The desired interaction between the head piece and the slider is accomplished in a simple manner by providing a circular cylindrical opening in the slider which corresponds to the diameter of the sphere.

The housing of the actuating device has a slideway corresponding to the swing radius of the toggle lever of the low-voltage circuit breaker which serves as the guide surface for the head piece. In this way, merely connecting the actuating device to the insulating housing of the low-voltage circuit breaker holds the head piece in the required engagement with the end of the toggle lever.

Figure 2:
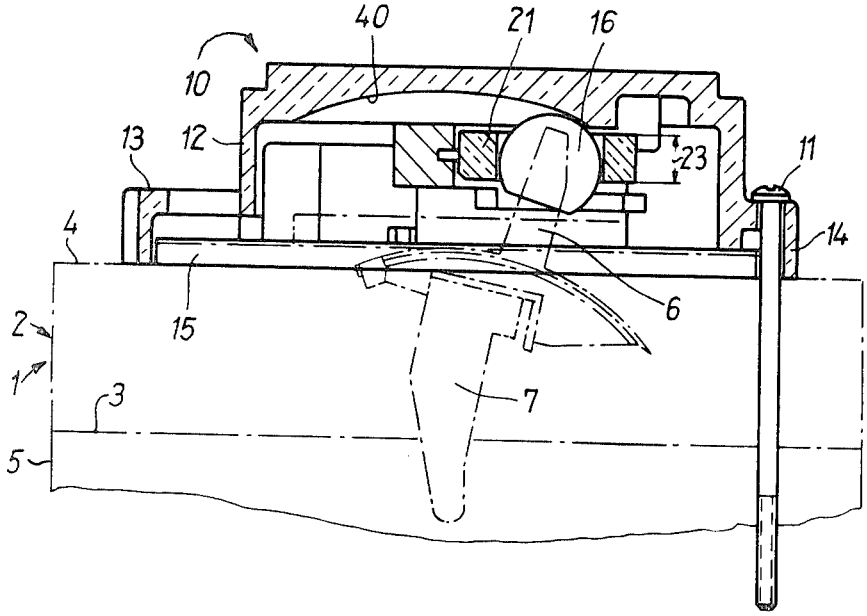
FIG. 2 is a side view of a low-voltage circuit breaker (in phantom) and a cross-section along line II—II of FIG. 1, of an actuating device attached to the breaker.

The low-voltage circuit breaker shown in phantom in FIG. 2 and a housing 2 of insulating material, which is divided into an upper part 4 and a lower part 5 along a parting line 3. A toggle lever 6 projecting from the housing is provided for switching circuit breaker 1 on and off, by hand, as is customary in the art. This toggle lever acts in a well known manner via an internal actuating lever 7, on the switching mechanism, not shown, of the circuit breaker 1. The circuit-breaker may be of the type shown in U.S. Pat. No. 3,752,947 or in U.S. Pat. No. 3,632,939.

Figure 4:
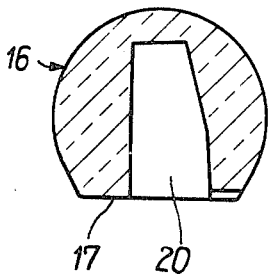
FIG. 4 is a view in cross-section of a head piece as taught by the invention.

An actuating device 10 is connected to insulating housing 2 and rests on upper part 4, being fastened thereto by means of screws 11. Actuating device 10 includes a housing having two oppositely disposed end portions 13 and 14, and extends over a base-like, raised portion 15 which is provided, in a known manner, on the front side of upper part 4. This aligns the actuating device relative to toggle lever 6. A substantially spherical head piece 16 (FIG. 4) is slipped over the end of toggle lever 6; it may be made of a suitable plastic material. Head piece 16 is provided with a flat 17, from which a receiving opening 20 for the end of the toggle lever 6 starts.

Figure 1:
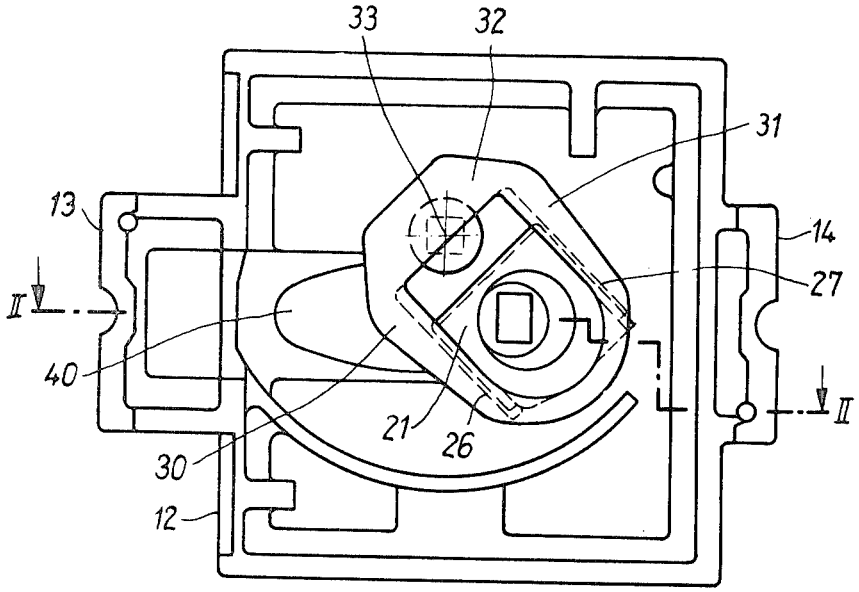
FIG. 1 shows an under view of an actuating device according to the invention, looking at the side which interacts with the toggle lever.
Figure 3:
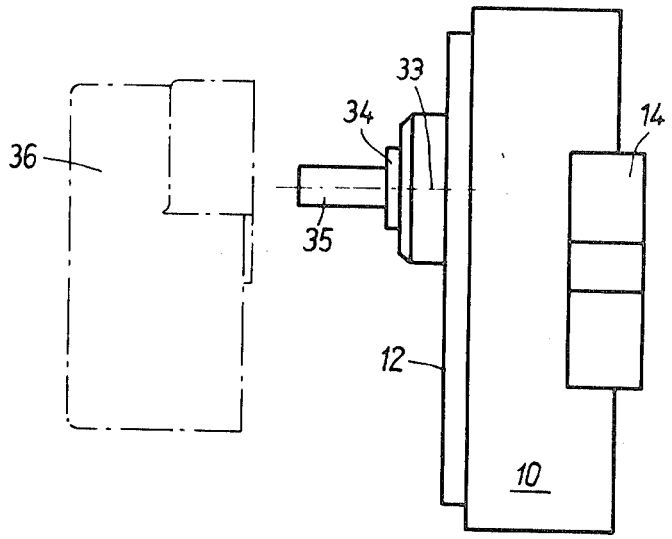
FIG. 3 shows an actuating device in a side view.
Figure 5:
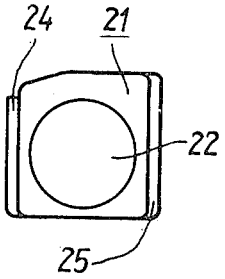
FIG. 5 shows a slider for use with the head piece of FIG. 4.

Head piece 16 cooperates with a slider 21 (FIG. 5), which has a circular cylindrical opening 22 corresponding to the diameter of head piece 16. The axial length 23 of opening 22 is chosen so that the wall of the cylinder forms a surface tangential to head piece 16 in all possible positions of the toggle lever 6. Slider 21 has two guide ribs 24 and 25, which engage in slots 26 and 27 of fork arms 30 and 31 of a lever 32 (FIGS. 1 and 2). Slider 21 can slide radially in slots 26 and 27, relative to fulcrum 33 of lever 32, when lever 32 is turned, rotating the toggle lever into the position opposite the position shown. Fork-shaped lever 32 is supported for rotation about a fulcrum 33 with its shift end 34 in a bearing opening of housing 12 (FIG. 3). The end 35 of shaft 34 protruding from housing 12 is square, and operating handle 36 or some other suitable actuating member can be placed on it. Head piece 16 runs in a recess slideway 40 of housing 12 of actuating device 10 (FIGS. 1 and 2). Slideway 40 has a radius of curvature corresponding to the length of the assembled actuating lever 7, toggle lever 6, and head piece 16.

As the figures show, an actuating device fabricated according to the teachings of the inventions contain only parts which cooperate by surface sliding. The wear is extremely slight. In addition, actuating device 10 can be adapted in a simple manner to fit differing toggle levers by using head pieces having appropriately shaped receiving openings, but having the same outside diameter.

What is claimed is:

1. An actuating device for attachment to a low-voltage circuit breaker having an insulating housing and a toggle lever protruding therefrom, comprising:

a housing, a guide mechanism, actuable by rotary motion, for translating the rotary motion into rectilinear motion, and a spherical head piece having an opening for receiving the end of the toggle lever, said guide mechanism having fork arms and a slider guided therein for motion relative to the axis of rotation which contains a receiving opening for the end of the toggle lever.

2. An actuating device according to claim 1 in which the fork arms are provided with slots for radially guiding the slider.

3. An actuating device according to claim 1 in which the spherical head piece is provided with a flat and the receiving opening therein for the end of the toggle lever starts from the flat.

4. An actuating device according to claim 3 in which the slider contains a circular cylindrical opening corresponding to the diameter of the spherical headpiece.

5. An actuating device according to claim 1 in which the housing of the actuating device has, as the guide surface for the head piece, a slideway of a radius corresponding to the swing radius of the toggle lever.

* * * * *